US010760748B2

(12) United States Patent
Liu et al.

(10) Patent No.: US 10,760,748 B2
(45) Date of Patent: Sep. 1, 2020

(54) HIGH ENVIRONMENTAL PROTECTIVE AND ENERGY-SAVING LED ILLUMINATION LAMP

(71) Applicant: Xiaojun Liu, Shenzhen (CN)

(72) Inventors: Xiaojun Liu, Shenzhen (CN); Junlong Liu, Shenzhen (CN)

(73) Assignee: Xiaojun Liu, Shenzhen (CN)

( * ) Notice: Subject to any disclaimer, the term of this patent is extended or adjusted under 35 U.S.C. 154(b) by 121 days.

(21) Appl. No.: 16/244,124

(22) Filed: Jan. 10, 2019

(65) Prior Publication Data

US 2020/0025345 A1 Jan. 23, 2020

(30) Foreign Application Priority Data

Jul. 19, 2018 (CN) ..... 2018 1 0795072

(51) Int. Cl.

| | |
|---|---|
| ***F21S 6/00*** | (2006.01) |
| ***F21V 29/60*** | (2015.01) |
| ***F21V 21/15*** | (2006.01) |
| ***F21V 21/22*** | (2006.01) |
| ***F21V 23/04*** | (2006.01) |
| *F21Y 105/12* | (2016.01) |
| *F21Y 107/90* | (2016.01) |
| *F21Y 115/10* | (2016.01) |
| *F21Y 107/50* | (2016.01) |

(52) U.S. Cl.

CPC ..... *F21S 6/002* (2013.01); *F21V 21/15* (2013.01); *F21V 21/22* (2013.01); *F21V 23/045* (2013.01); *F21V 23/0464* (2013.01); *F21V 23/0471* (2013.01); *F21V 23/0485* (2013.01); *F21V 29/60* (2015.01); *F21Y 2105/12* (2016.08); *F21Y 2107/50* (2016.08); *F21Y 2107/90* (2016.08); *F21Y 2115/10* (2016.08)

(58) Field of Classification Search

CPC ..... F21S 6/002; F21V 29/60; F21V 21/15; F21V 21/22; F21V 23/045; F21V 23/0464; F21V 23/0471; F21V 23/0485; F21Y 2105/12; F21Y 2107/90; F21Y 2115/10; F21Y 2107/50

USPC ..... 362/234

See application file for complete search history.

(56) References Cited

FOREIGN PATENT DOCUMENTS

CN 205782178 U * 12/2016 ..... F21V 21/06

OTHER PUBLICATIONS

English translation of CN 205782178 U to Dormann (Dec. 2016), downloaded from Espacenet Jul. 2, 2020 (Year: 2020).*

* cited by examiner

*Primary Examiner* — Cara E Rakowski
*Assistant Examiner* — Hana S Featherly

(57) ABSTRACT

A high environmental protective and energy-saving LED illumination lamp includes a base, a first lamp body assembly arranged on an upper portion of the base, and a second lamp body assembly arranged on an upper portion of the first lamp body assembly. A controller, a power supply, a data memory, a wireless communication transmission unit configured to communicate with an external mobile terminal, an alerter configured to generate an alarm sound in case of an emergency, a sound device, and a voltage stabilizer are arranged inside the base. A first rotary drive motor is arranged inside the base. A rotary disc configured to support the first lamp body assembly is arranged between the base and the first lamp body assembly. The first rotary drive motor drives the rotary disc to rotate to drive the first lamp body assembly to rotate synchronously.

6 Claims, 3 Drawing Sheets

HIGH ENVIRONMENTAL PROTECTIVE AND ENERGY-SAVING LED ILLUMINATION LAMP

BACKGROUND

1. Technical Field

The present disclosure relates to a field of light emitting diode (LED) lamp technology, and in particularly to a high environmental protective and energy-saving LED illumination lamp with reasonable structural design and good use effect.

2. Description of Prior Art

With continuous advancement of technology, light emitting diodes (LED) are widely used in displays, TV, lighting decorations, and lighting. At present, with development of industry, technical leaps and technical breakthroughs, and promotions of applications, light efficiency of LED is also constantly improving, and price of the LED is reducing. The LED has advantages such as energy saving, long service life, low power consumption, easy maintenance, etc. Thus, it is widely used in various fields, such as indication, display, backlight source, common lighting, and etc. Home lamps are useful most of the time. A conventional table lamp mostly uses light bulbs to provide illumination, which may affect eyesight of a child. And heat dissipation efficiency of the table lamp is not high, and a surface of a lamp body is often very hot, further, the table lamp consumes a large amount of electric energy. Thus, long-term use will affect a normal use of the table lamp. In addition, most conventional illumination lamps provide a single-sided illumination and a illumination range of conventional illumination lamps is relatively limited, further, the conventional illumination lamps are mainly powered by an external power supply. Such a conventional structure design requires a large amount of power, and is costly and puts a large burden to users. Meanwhile, most of the illumination lamps use incandescent lamps as light bulbs, but incandescent lamps have many limits such as poor luminous efficiency, high energy consumption, large amount of heat, and short service life, which bring more trouble to users and are not conducive to a better promotion and use of products.

Based on above problems, a large number of research, development and experiments have been carried out by those skilled in the art, and improvements have been made from various aspects such as specific structures and functions of an LED illumination lamp, and good results have been obtained.

SUMMARY

In order to overcome the problems existing in the prior art, the present disclosure provides a high environmental protective and energy-saving light emitting diode (LED) illumination lamp with reasonable structural design and good use effect.

Compared with the prior art, the present disclosure of a high environmental protective and energy-saving LED illumination lamp comprises a base, a first lamp body assembly arranged on an upper portion of the base, and a second lamp body assembly arranged on an upper portion of the first lamp body assembly. A controller, a power supply, a data memory, a wireless communication transmission unit configured to communicate with an external mobile terminal, an alerter configured to generate an alarm sound in case of an emergency, a sound device, and a voltage stabilizer are arranged inside the base. Combined with arrangements of a rotary disc, a connecting rod, and a telescopic rod, in an actual use, the rotary disc, the connecting rod, the telescopic rod and an angle adjusting mechanism assembly work together to flexibly change a irradiation orientation of the first lamp body assembly and the second lamp body assembly, thereby improving an use effect. The present disclosure of the high environmental protective and energy-saving LED illumination lamp is reasonable in structural design, high in intelligence, and beautiful in appearance.

DETAILED DESCRIPTION

To make the objects, technical proposals and merits of the present disclosure more apparent, the present disclosure will be further described in detail with reference to the drawings and embodiments. It should be understood that the embodiments described here are only used to illustrate the present disclosure and are not intended to limit the present disclosure.

Figure 1:
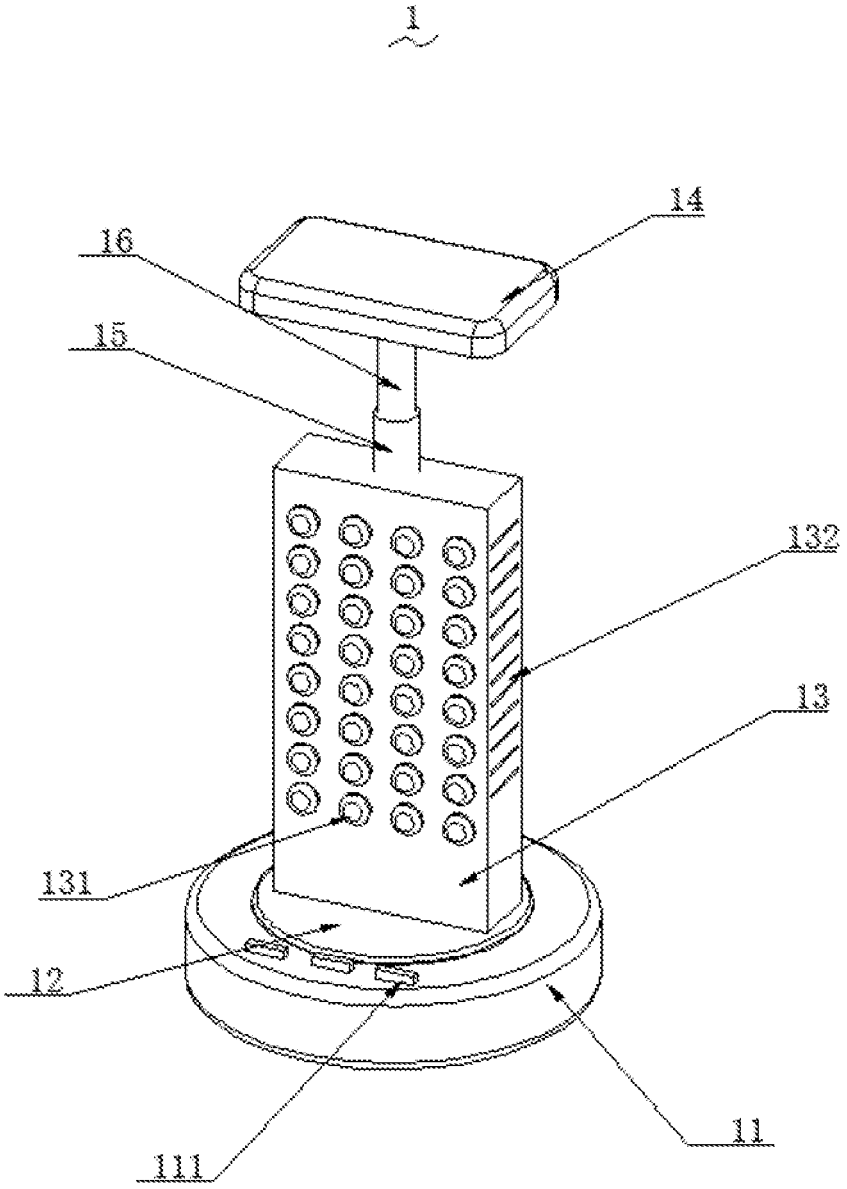
FIG. 1 is a perspective view showing a structure diagram of a high environmental protective and energy-saving LED illumination lamp of the present disclosure.
Figure 2:
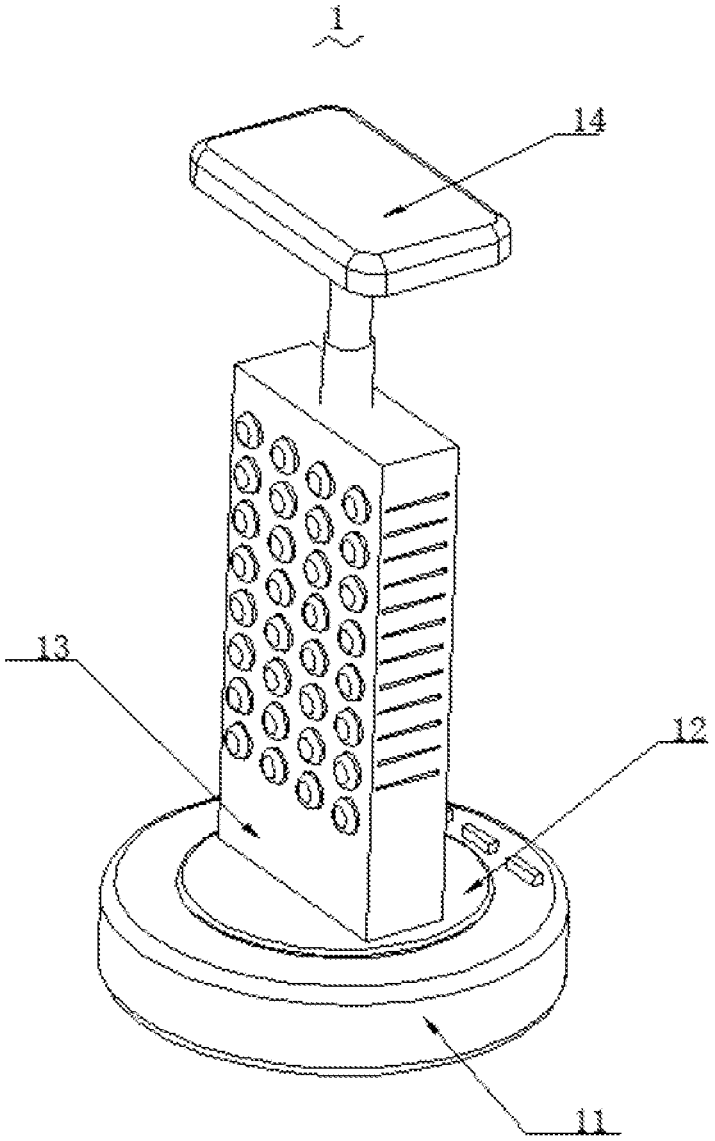
FIG. 2 is another perspective view showing a structure diagram of the high environmental protective and energy-saving LED illumination lamp of the present disclosure.
Figure 3:
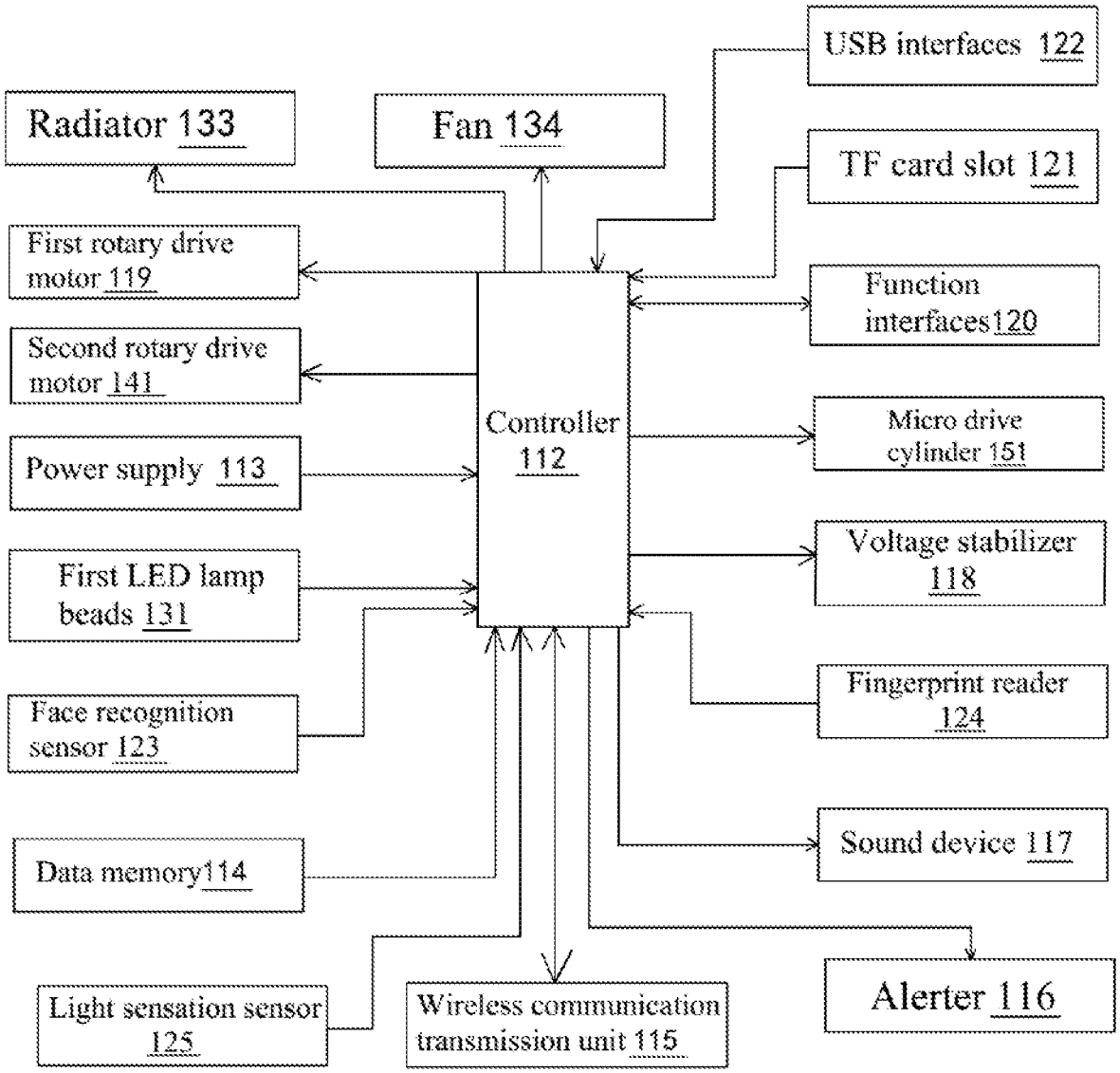
FIG. 3 is a structure diagram showing a circuit connection structure of the high environmental protective and energy-saving LED illumination lamp of the present disclosure.

As shown in FIG. 1 to FIG. 3, the present disclosure of a high environmental protective and energy-saving LED illumination lamp 1 comprises a base 11, a first lamp body assembly 13 arranged on an upper portion of the base 11, and a second lamp body assembly 14 arranged on an upper portion of the first lamp body assembly 13. A controller 112, a power supply 113, a data memory 114, a wireless communication transmission unit 115 configured to communicate with an external mobile terminal, an alerter 116 configured to generate an alarm sound in case of an emergency, a sound device 117, and a voltage stabilizer 118 are arranged inside the base 11. The data memory 114, the wireless communication transmission unit 115*t*, the alerter 116, the sound device 117, and the voltage stabilizer 118 are electrically connected with the controller 112. A first rotary drive motor 119 is arranged inside the base 11. A rotary disc 12 configured to support the first lamp body assembly 13 is arranged between the base 11 and the first lamp body assembly 13. The first rotary drive motor 119 drives the rotary disc 12 to rotate so as to drive the first lamp body assembly 13 to rotate synchronously.

The first lamp body assembly 13 is of a square structure. The first lamp body assembly 13 comprises a first shell, a radiator 133 arranged inside the first shell, and a fan 134. The fan 134 is configured to reinforce air flow inside the first shell. A plurality of first LED lamp beads 131 are arranged on a front surface and a rear surface of the first shell, where the first LED lamp beads 131 are evenly arranged in a rectangular array. Two sides of the first shell defining heat dissipation holes 132. The first rotary drive motor 119, the radiator 133, the fan 134, the first LED lamp beads 131 are electrically connected with the controller 112. The second lamp body assembly 14 and the first lamp body assembly 13 are connected by a connecting rod 15 and a telescopic rod 16. The telescopic rod 16 is arranged on an upper portion of the connecting rod 15. A micro drive cylinder 151 configured to drive the telescopic rod 16 to move up and down relative to the connecting rod 15 is arranged inside the connecting rod 15. The second lamp body assembly 14 comprises a second shell and a plurality of second LED lamp beads arranged on a bottom surface of the second shell. The micro drive cylinder 151 and the second LED lamp beads are electrically connected with the controller 112.

A plurality of control buttons 111 are arranged on the upper portion of the base 11. A plurality of function interfaces 120, a TF card slot 121, and a plurality of USB (universal serial bus) interfaces 122 are arranged on a rear portion of the base 11. The control buttons 111, the function interfaces 120, the TF card slot 121, and the USB interfaces 122 are electrically connected with the controller 112. An angle adjusting mechanism assembly configured to flexibly and automatically adjust an irradiation angle of the second lamp body assembly 14 is arranged on a connecting portion of the telescopic rod 16 and the second lamp body assembly 14. The angle adjusting mechanism assembly comprises a rotary support member configured to support the second lamp body assembly 14 and a second rotary drive motor 141 configured to drive the second lamp body assembly 14 to rotate relative to the telescopic rod 16. The rotary support member and the telescopic rod 16 are connected by a rotary shaft. The second rotary drive motor 141 is electrically connected with the controller 112. The first lamp body assembly 13 has a length in a range of 10-12 cm, a width in a range of 3-5 cm, and a height in a range of 8-11 cm. The second lamp body assembly 14 has a length in a range of 6-8 cm, a width in a range of 3-5 cm, and a height in a range of 2-4 cm.

A non-slip mat configured to prevent the LED illumination lamp 1 from sliding is arranged on any of four diagonal positions arranged at a bottom portion of the base 11. The non-slip mat ranges from 5-12 mm in thickness. A face recognition sensor 123, a fingerprint reader 124, and a light sensation sensor 125 are arranged on the front surface of the base 11. The face recognition sensor 123 is configured to perform face recognition and face sensing. The fingerprint reader 124 is configured to control an operation of the LED illumination lamp 1. The light sensation sensor 125 is configured to sense a real-time intensity of external light. The face recognition sensor 123, the fingerprint reader 124, and the light sensation sensor 125 are electrically connected with the controller 112.

The present disclosure of the high environmental protective and energy-saving LED illumination lamp 1 comprises the base 11, the first lamp body assembly 13 arranged on the upper portion of the base 11, and the second lamp body assembly 14 arranged on the upper portion of the first lamp body assembly. The controller 112, the power supply, the data memory, the wireless communication transmission unit configured to communicate with the external mobile terminal, the alerter configured to generate the alarm sound in case of the emergency, the sound device, and the voltage stabilizer are arranged inside the base 11. Combined with arrangements of the rotary disc 12, the connecting rod 15, and the telescopic rod 16, in the actual use, the rotary disc 12, the connecting rod 15, the telescopic rod 16, and the angle adjusting mechanism assembly work together to flexibly change a irradiation orientation of the first lamp body assembly 13 and the second lamp body assembly 14, thereby improving an use effect. The present disclosure of the high environmental protective and energy-saving LED illumination lamp 1 is reasonable in structural design, high in intelligence, and beautiful in appearance.

Furthermore, the wireless communication transmission unit comprises a wireless BLUETOOTH unit, a 2.4G wireless communication unit, and a WIFI transmission unit.

Furthermore, the connecting rod 15 ranges from 10-13 mm in diameter. The telescopic rod 16 ranges from 8-10 mm in diameter, and the base 11 is cylindrical.

Furthermore, the power source is a rechargeable lithium battery.

Furthermore, a plurality of solar panels arranged on an other surface of the second shell relative to the second LED lamp heads. The solar panel are arranged parallelly at equal intervals, and a spacing between the solar panels ranges from 0.55-0.85 cm.

Furthermore, the first shell comprises an upper shell and a lower shell engaged with the upper shell. A waterproof rubber ring is sleeved on the connecting portion of the upper casing and the lower casing.

Compared with the prior art, the present disclosure of the high environmental protective and energy-saving LED illumination lamp 1 comprises the base 11, the first lamp body assembly 13 arranged on the upper portion of the base 11, and the second lamp body assembly 14 arranged on the upper portion of the first lamp body assembly 13. The controller 112, the power supply, the data memory, the wireless communication transmission unit configured to communicate with the external mobile terminal, the alerter configured to generate the alarm sound in case of the emergency, the sound device, and the voltage stabilizer are arranged inside the base 11. Combined with arrangements of the rotary disc 12, the connecting rod 15, and the telescopic rod 16, in the actual use, the rotary disc 12, the connecting rod 15, the telescopic rod 16, and the angle adjusting mechanism assembly work together to flexibly change the irradiation orientation of the first lamp body assembly 13 and the second lamp body assembly 14, thereby improving the use effect. The present disclosure of the high environmental protective and energy-saving LED illumination lamp 1 is reasonable in structural design, high in intelligence, and beautiful in appearance.

The above-described embodiments of the present disclosure are not to be construed as limiting the scope of the present disclosure. Any of the modifications, equivalent replacement, and improvement within the spirit and principle of the present disclosure should fall within the protection scope of the claim.

What is claimed is:

1. A high environmental protective and energy-saving light emitting diode (LED) illumination lamp, comprising:

a base;

a first lamp body assembly arranged on an upper portion of the base; and a second lamp body assembly arranged on an upper portion of the first lamp body assembly;

wherein a controller, a power supply, a data memory, a wireless communication transmission unit configured to communicate with an external mobile terminal, an alerter configured to generate an alarm sound in case of an emergency, a sound device, and a voltage stabilizer are arranged inside the base; the data memory, the wireless communication transmission unit, the alerter, the sound device and the voltage stabilizer are electrically connected with the controller; a first rotary drive motor is arranged inside the base; and a rotary disc configured to support the first lamp body assembly is arranged between the base and the first lamp body assembly; the first rotary drive motor drives the rotary disc to rotate to drive the first lamp body assembly to rotate synchronously;

wherein the first lamp body assembly is of a square structure; the first lamp body assembly comprises a first shell, a radiator arranged inside the first shell, and a fan; the fan is configured to reinforce air flow inside the first shell; a plurality of first LED lamp beads are arranged on a front surface and a rear surface of the first shell; and the first LED lamp beads are evenly arranged in a rectangular array; two sides of the first shell defining heat dissipation holes; the first rotary drive motor, the radiator, the fan, and the first LED lamp beads are electrically connected with the controller; the second lamp body assembly and the first lamp body assembly are connected by a connecting rod and a telescopic rod; the telescopic rod is arranged on an upper portion of the connecting rod; a micro drive cylinder configured to drive the telescopic rod to move up and down relative to the connecting rod is arranged inside the connecting rod; the second lamp body assembly comprises a second shell and a plurality of second LED lamp beads arranged on a bottom surface of the second shell; the micro drive cylinder and the second LED lamp beads are electrically connected with the controller;

wherein a plurality of control buttons are arranged on the upper portion of the base; and a plurality of function interfaces, a TF card slot, and a plurality of USB (universal serial bus) interfaces are arranged on a rear portion of the base; the control buttons, the function interfaces, the TF card slot, and the USB interfaces are electrically connected with the controller; an angle adjusting mechanism assembly configured to flexibly and automatically adjust an irradiation angle of the second lamp body assembly is arranged on a connecting portion of the telescopic rod and the second lamp body assembly; the angle adjusting mechanism assembly comprises a rotary support member configured to support the second lamp body assembly and a second rotary drive motor configured to drive the second lamp body assembly to rotate relative to the telescopic rod; the rotary support member and the telescopic rod are connected by a rotary shaft; the second rotary drive motor is electrically connected with the controller; the first lamp body assembly has a length in a range of 10-12 cm, a width in a range of 3-5 cm, and a height in a range of 8-11 cm; the second lamp body assembly has a length in a range of 6-8 cm, a width in a range of 3-5 cm, and a height in a range of 2-4 cm;

wherein a non-slip mat configured to prevent the LED illumination lamp from sliding is arranged on any of four diagonal positions arranged at a bottom portion of the base; the non-slip mat ranges from 5-12 mm in thickness; a face recognition sensor, a fingerprint reader, and a light sensation sensor are arranged on the front surface of the base; the face recognition sensor is configured to perform face recognition and face sensing; the fingerprint reader is configured to control an operation of the LED illumination lamp; the light sensation sensor is configured to sense a real-time intensity of external light; the face recognition sensor, the fingerprint reader, and the light sensation sensor are electrically connected with the controller.

2. The high environmental protective and energy-saving LED illumination lamp according to claim 1, wherein the wireless communication transmission unit comprises a wireless BLUETOOTH unit, a 2.4G wireless communication unit, and a WIFI transmission unit.

3. The high environmental protective and energy-saving LED illumination lamp according to claim 1, wherein the connecting rod ranges from 10-13 mm in diameter; the telescopic rod ranges from 8-10 mm in diameter; and the base is cylindrical.

4. The high environmental protective and energy-saving LED illumination lamp according to claim 1, wherein the power source is a rechargeable lithium battery.

5. The high environmental protective and energy-saving LED illumination lamp according to claim 1, wherein a plurality of solar panels arranged on an other surface of the second shell relative to the second LED lamp heads; the solar panel are arranged parallelly at equal intervals, and a spacing between the solar panels ranges from 0.55-0.85 cm.

6. The high environmental protective and energy-saving LED illumination lamp according to claim 1, wherein the first shell comprises an upper shell and a lower shell engaged with the upper shell; a waterproof rubber ring is sleeved on the connecting portion of the upper casing and the lower casing.

* * * * *